United States Patent [19]

Oberdörfer

[11] Patent Number: 4,977,920

[45] Date of Patent: Dec. 18, 1990

[54] PIPE INTERRUPTER

[75] Inventor: Hans Oberdörfer, Stuttgart, Fed. Rep. of Germany

[73] Assignee: Hansa Metallwerke AG, Stuttgart, Fed. Rep. of Germany

[21] Appl. No.: 434,343

[22] Filed: Nov. 13, 1989

[30] Foreign Application Priority Data

Nov. 24, 1988 [DE] Fed. Rep. of Germany ..... 3839650

[51] Int. Cl.[5] ..... F16L 55/07; E03C 1/10

[52] U.S. Cl. ..... 137/218; 137/102

[58] Field of Search ..... 137/102, 218

[56] References Cited

U.S. PATENT DOCUMENTS 2,877,789 3/1959 Campbell .

3,084,707 4/1963 Frye ..... 137/102

FOREIGN PATENT DOCUMENTS 1988593 6/1968 Fed. Rep. of Germany .

OTHER PUBLICATIONS

German Industry Standard DIN 3266, Part 1, Jul. 1986.

*Primary Examiner*—Gerald A. Michalsky

*Attorney, Agent, or Firm*—Fred Philpitt

[57] ABSTRACT

A pipe interrupter, which is particularly suitable for installation in a sanitary fitting, comprises in a housing a chamber, into which a water-supply passage, a water-discharge passage and a ventilation path open. Located in the chamber is a rolling membrane, which is fixed at the peripheral region. Normally, thus as long as there is no reduced pressure in the supply passage, the rolling membrane bears in the central region against the opening aperture of the ventilation path in the chamber, so that on the one hand no atmospheric air may enter and on the other hand no water may escape. However, if reduced pressure occurs in the pipe system, which is connected to the supply passage, then the rolling membrane overturns so that now on the opposite side of the central region it closes the opening point of the supply passage into the chamber. On the other side, a ventilation path to the chamber is exposed. This ventilation path continues by way of a through-flow opening in the edge region of the rolling membrane towards the discharge passage. In this way, water can no longer flow back into the supply passage and into the pipe system connected thereto; on the other hand, the water-ways following the chamber are ventilated.

1 Claim, 1 Drawing Sheet

PIPE INTERRUPTER

The invention relates to a pipe interrupter for sanitary installations, in particular for installation in a sanitary fitting, with (a) a housing;

(b) a chamber in the housing, into which open the following:

(ba) a supply passage for water;

(bb) a discharge passage for water;

(bc) a ventilation path;

(c) a resilient closing member in the chamber, which at the time of reduced pressure in the supply passage closes the latter and opens the ventilation path.

It is known that sanitary fittings exist which may endanger the quality of the drinking water due to sucking-back of contaminated water. These include in particular bath/shower sets with a flexible pipe shower head or handbasin and sink fittings with a flexible pipe shower head which can be pulled out. Fittings of this type must comprise safety devices, by which the sucking-back of contaminated water into the drinking water can be reliably prevented. Safety devices of this type normally comprise a pipe interrupter or ventilator.

A pipe interrupter of the aforementioned type is known from DIN 3266, July 1966, FIG. 2. In this case, provided coaxially with respect to the water supply passage in the chamber of the housing is a connection, through which radial throughflow openings for the water are guided. Provided coaxially with respect to the wall of this connection is an outer wall, which contains the openings for the admission of air. The resilient closing member is constructed as a hollow, cylindrical part, which without the throughflow of water bears against the inner connection and closes off the water throughflow openings, thus simultaneously releases the air openings. As soon as water at excess pressure is present in the supply passage, the water presses the hollow, cylindrical closing member radially outwards, so that on the one hand the waterway into the chamber is opened and on the other hand the air supply by way of the radial ventilation openings is blocked.

This known pipe interrupter ("design A 2") however is so large that it is ill-suited for installation in a sanitary fitting. Furthermore it has a relatively complicated construction.

It is the object of the present invention to provide a pipe interrupter of the aforementioned type so that it can be realized in the smallest space with low expenditure and is particularly suitable for installation in a sanitary fitting.

This object is achieved according to the invention due to the fact that (d) the resilient closing member is constructed as a rolling membrane, which (da) is fixed in the peripheral region;

(db) in the central region without reduced pressure in the supply passage bears resiliently against the opening of the ventilation path into the chamber;

(dc) when reduced pressure occurs in the supply passage, it overturns and then bears against the opening of the supply passage into the chamber;

(dd) in the edge region outside the central region it comprises a throughflow opening, through which air may flow in the case dc from the ventilation path to the discharge passage.

On account of its small dimensions, a pipe interrupter according to the invention can be installed without problems in the bottom region of a sanitary fitting. The sensitivity of response of the rolling membrane is great, since only relatively low forces are necessary for its overturning and a resilient expansion does not need to take place.

One embodiment of the invention will be described in detail hereafter with reference to the drawings, in which.

Figure 1:
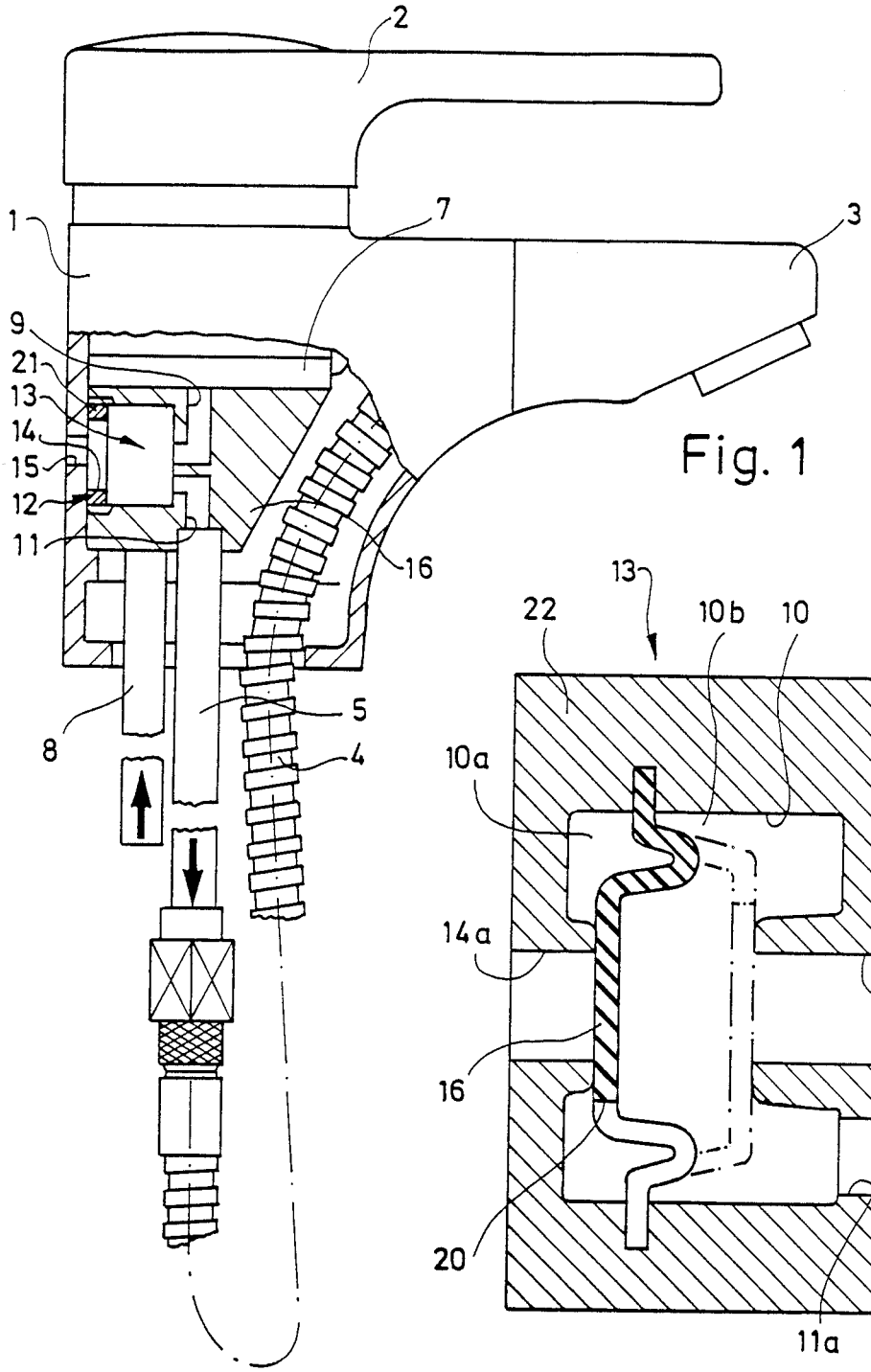
FIG. 1 is a side view of a sanitary fitting with installed pipe interrupter, partly in section.

The sanitary fitting illustrated in FIG. 1 comprises in known manner a fitting body 1, an operating lever 2 which is able to rotate and tilt as well as an outlet mouthpiece 3 which can be pulled out. The latter is connected to an outlet pipe 5 by way of a shower-head flexible pipe 3 arranged in a loop, which is guided partly within the fitting body 1 and partly through the hole in the basin to be imagined below the sanitary fitting. The outlet pipe 5 is fastened in a base part 6, which rests on an inner step of the fitting body 1. The base part 6 supports a control cartridge 7, which can be constructed in known manner and in which the control elements necessary for controlling the water stream or water streams are combined. These control elements are moved in an appropriate manner by means of the handle 2. Two supply pipes 8 for cold and hot water likewise extend through the hole in the basin and from below into the fitting body 1. They pass through the base part 6 and are connected in known manner to the control cartridge 7.

The mixed water delivered by the control cartridge 7 according to the relative position of the control elements passes by way of a passage 9 into a pipe interrupter, which is constructed as an insert 13 and is introduced from the side into the base part 6. It is held there by a screw part 21. Guided concentrically with respect to the annular part 21 through the fitting body 1 is a bore 15, which is part of a ventilation path for the pipe interrupter 13, as will become clear hereafter.

A further passage 11 leads from the pipe interrupter 13 to the outlet pipe 5.

Figure 2:
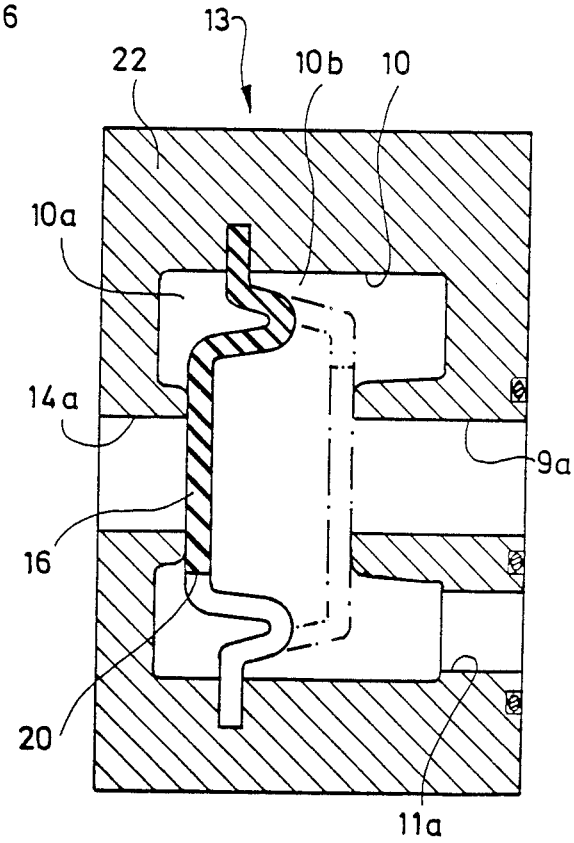
FIG. 2 is a section through the pipe interrupter of FIG. 1, to an enlarged scale.

The pipe interrupter 13, which is shown fitted in the fitting in FIG. 1, is shown to an enlarged scale and in section in FIG. 2.

A chamber 10 is formed in a housing 22 of the pipe interrupter 13. Opening into the latter, on the lefthand side of the drawing, is a passage **14*a*, which is part of the ventilation path and is connected to the bore 15 in the fitting body 1. Opening coaxially thereto, on the opposite side, into the chamber 10, is a passage 9*a*, which is connected to the passage 9 in the base part 6 and is part of the water-way between the control cartridge 7 and the outlet pipe 5. Finally, a further passage 11*a* opens out parallel to the passage 9*a*, somewhat below the latter, which passage 11*a* is connected to the outlet passage 11 in the base part 6 and thus to the outlet pipe 5. The chamber 10 is divided by a rolling membrane 16, which is fixed on its periphery in the housing 22, into two chambers 10*a* and 10*b*. Normally, as long as there is no reduced pressure in the passage 9*a*, the rolling membrane 16 bears in its central region against the opening point of the passage 14*a* in the chamber 10 and thus closes the ventilation path. On the other hand, the opening aperture of the passage 9*a* into the chamber 10 is open, so that water flows from the control cartridge 7 to the outlet mouthpiece 3**.

Now if a reduced pressure occurs in the supply passage 9a, the rolling membrane 16 overturns so that—as shown in dot—dash line in FIG. 2—it is lifted from the opening of the passage 14a and bears against the opening of the passage 9a. Due to this the air path from the passage 14a in the half of the chamber 10a on the left in FIG. 2 is released. From there, the air may flow through an opening 20 in the edge region of the rolling membrane 16 into the right-hand half 10b of the chamber in FIG. 2 and from there into the passage 11a and the following flow paths.

In this case, the rolling membrane 16 bearing against the opening point of the passage 9a simultaneously blocks the return of water from the subsequent waterway, so that a contamination of the drinking water by contaminated shower water which is sucked-in, is impossible.

What is claimed:

1. A water pipe flow interrupter (13) for sanitary installations which includes (a) a housing (22);

(b) a chamber (10) in the housing (27), (c) a resilient closing member (16) positioned within and dividing said chamber (10), said resilient closing member (16) comprising a peripheral portion and a non-peripheral portion, (d) a water supply passage (9a) and a water discharge passage (11a) both opening into said chamber (10) on one side of said resilient closing member (16), and (e) a ventilation path (14a) opening into said chamber on the other side of said resilient closing member (16), characterized in that (A) said peripheral portion of said resilient closing member (16) being fixed to the interior of said chamber (10), (B) said non-peripheral portion of said resilient closing member (16) being flexible and being movable from a first position to a second position within said chamber (10) depending upon the pressure of the water in said supply passage (9a), namely when the water pressure in the supply passage (9a) is not reduced said non-peripheral portion moves to a first position to bear against and close the opening of the ventilation path (14a), and when the water pressure in the supply passage (9a) is reduced said nonperipheral portion moves to a second position to bear against and close the opening of the supply passage (9a), (C) a portion of said non-peripheral portion of said resilient closing member being provided with an opening (20), said opening (20) being located in said non-peripheral portion so that air may flow from the ventilation path (14a) to the discharge passage (11a) when said non-peripheral portion is in said second position closing off water flow through said supply passage (9a) and located so that no air will flow from the ventilation path (14a) to the discharge passage (11a) when said non-peripheral portion is in said first position.

* * * * *